US006106032A

United States Patent [19]

Och

[11] Patent Number: 6,106,032

[45] Date of Patent: Aug. 22, 2000

[54] PNEUMATIC DOOR LOCK

[75] Inventor: Mathias Och, Montreux, Switzerland

[73] Assignee: Festo KG, Esslingen, Denmark

[21] Appl. No.: 08/849,327

[22] PCT Filed: May 13, 1996

[86] PCT No.: PCT/CH96/00183

§ 371 Date: Sep. 15, 1997

§ 102(e) Date: Sep. 15, 1997

[87] PCT Pub. No.: WO97/11246

PCT Pub. Date: Mar. 27, 1997

[30] Foreign Application Priority Data

Sep. 20, 1995 [CH] Switzerland ..... 2654/95

[51] Int. Cl.[7] ..... E05C 3/04

[52] U.S. Cl. ..... 292/207; 292/195

[58] Field of Search ..... 292/201, 207, 292/92, 93, DIG. 48, DIG. 66, 195, DIG. 57, DIG. 38; 70/275

[56] References Cited

U.S. PATENT DOCUMENTS

| | | | |
|---|---|---|---|
| 1,038,624 | 1/1912 | Messick | 70/275 |
| 1,085,058 | 1/1914 | Messick | 70/275 |
| 3,950,018 | 4/1976 | Pickering | 292/144 |
| 3,999,790 | 12/1976 | Rogen | 292/201 |
| 4,021,066 | 5/1977 | McShane | 292/144 |
| 4,169,616 | 10/1979 | Peterson | 292/144 |
| 4,266,415 | 5/1981 | Clarke | 70/264 |
| 4,324,425 | 4/1982 | Logan | 292/201 |
| 4,691,948 | 9/1987 | Austin, Jr. et al. | 292/171 |
| 4,901,474 | 2/1990 | Bayard et al. | 49/26 |
| 5,056,838 | 10/1991 | Tiesler et al. | 292/336.3 |
| 5,121,950 | 6/1992 | Davidian | 292/92 |
| 5,288,037 | 2/1994 | Derrien | 244/102 |
| 5,328,219 | 7/1994 | Konchan | 292/216 |
| 5,342,204 | 8/1994 | Och | 439/39 |
| 5,380,053 | 1/1995 | Saino | 292/DIG. 66 |
| 5,397,238 | 3/1995 | Och | 439/39 |
| 5,762,385 | 6/1998 | Mader et al. | 292/92 |

*Primary Examiner*—B. Dayoan
*Assistant Examiner*—Gary Estremsky
*Attorney, Agent, or Firm*—Jenkens & Gilchrist, P.C.

[57] ABSTRACT

The invention concerns a lock for doors or operationally similar structures, the lock mechanism being manually actuated with the aid of pneumatic means, without the need for external energy. Means for manually producing overpressure are rigidly connected to a door. Further means are provided for converting the overpressure into a mechanical movement of parts of the closure mechanism, such that there is no longer any force-locking connection between the door and a counterpart in the door frame whereby the door can be opened.

6 Claims, 2 Drawing Sheets

PNEUMATIC DOOR LOCK

BACKGROUND OF THE INVENTION

The current invention relates to a lock for doors or operationally similar structures, in which the mechanism is manually actuated with the aid of pneumatic means.

The application of pneumatic methods in locking mechanisms is known chiefly for the turning or sliding of the door itself, such as presented for instance in U.S. Pat. No. 4,901,474. Solutions for the actuation of the moving parts of a lock only, using the application of compressed air, have also been suggested. Common to all these solutions is that the locking mechanisms require the importation of external energy.

In U.S. Pat. No. 4,021,066 a pneumatic door bolting system for lorries or railway wagons is proposed; in these vehicles compressed air is as a rule immediately available for braking. The lock proposed in U.S. Pat. No. 4,169,616 requires an air pressure line to the lock from an external source, with which an expensive transmission part from the fixed door frame to the moving door is provided. This applies similarly for the locking system proposed in U.S. Pat. No. 4,691,948. The solutions quoted are based on the supply of external energy, because the manually achievable short-term pneumatic energy is small and is not sufficient to overcome the substantial friction forces, which arise in the opening of conventional door locks.

SUMMARY OF THE INVENTION

The objective, which is addressed by the current invention, is to find a lock for doors and operationally similar structures, such as, for example, windows or sliding doors, whose mechanism is actuated with the aid of pneumatic means, without the requirement for external supply of energy.

DETAILED DESCRIPTION

Figure 1:
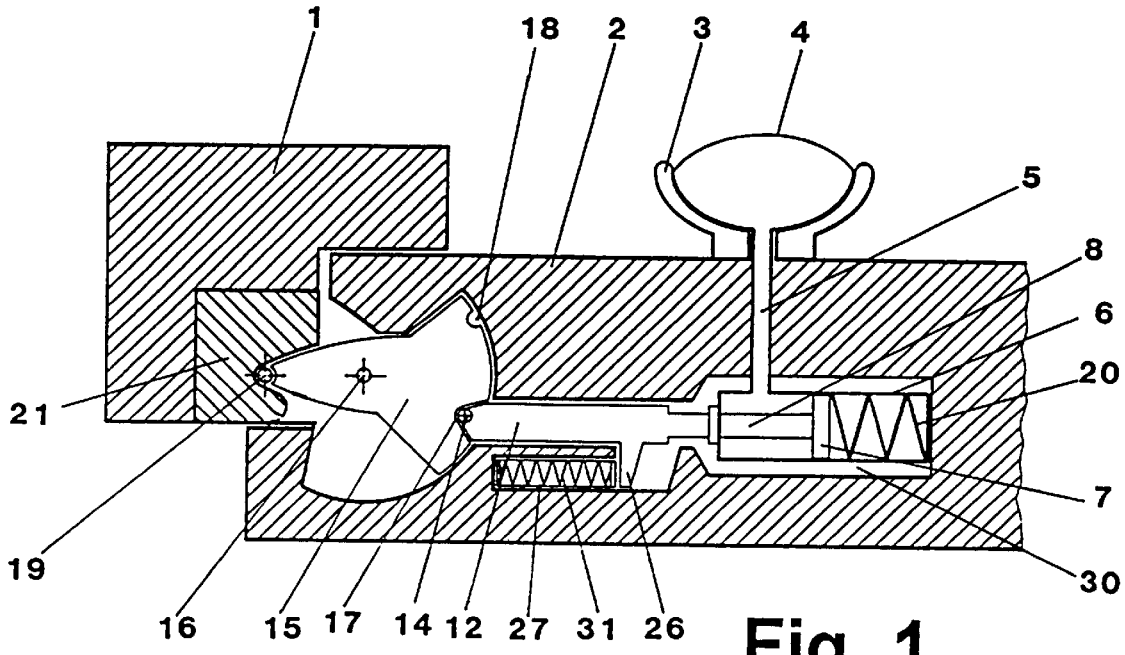
FIG. 1 is a cross section of a first embodiment of the pneumatic door lock according to the invention.

In FIG. 1 is given the schematic cross section through a first embodiment of the pneumatic door lock. In a non-moving door frame, from which only that part of the door frame 1 is shown, which lies adjacent to the lock, a door 2 is mounted, which is pivoted so as to swivel about a (not shown) vertical axis. Means for the generation of pressure are incorporated in the door 2. These means, comprise a door handle 3, which is firmly fixed to the door 2, in which a hollow body 4 is incorporated, which can be manually compressed, so that its internal volume is decreased. The hollow body 4 here comprises a balloon made of rubber or plastic material. In the sense of the invention it can, however, comprise parts which are sealed one to the other fitting into each other in a telescopic manner. The hollow body 4 is joined in an airtight manner via a primary connecting tube 5 to an actuator 30, which converts the pressure into a mechanical movement. This is, as are the other parts of the locking mechanism, built in to the inner part of the door 2, for instance in a (not shown) housing, such as is known from conventional locks. In this form of construction the actuator 30 comprises a pressure cylinder 6, a piston 7 which can be moved in it and a piston rod 8 which is fixed to it and guided essentially along a straight line. In a further embodiment, not shown, the actuator 30 comprises a bellows of metal or an elastomer. A longitudinal locking bolt 12 is joined at one end firmly to the piston rod 8 and arranged similarly to be movable along the same straight line. Its other end advantageously includes means by which frictional forces can be minimized. These means comprise here for example a suitable spring-supported first roller race 14; other friction reducing means are however also possible, for instance the use of special low friction and low wear materials, or the application of sufficient lubricating grease materials between parts which slide on each other.

A rotating bolt 15 is positioned about a turning axis 16 fixed firmly to the door so that it can turn within an angular region defined by stops to an order of magnitude of some 45°. An outer part of the rotating bolt 15 extends out of the lock against a part of the door frame 1. This outer part similarly includes means for reducing frictional forces, which comprise here a spring-supported second roller race 19. Here also, as already mentioned in the case of first roller race 14, other friction-reducing means are possible. An inner part of the rotating bolt 15, lying on the other side of the turning axis 16, includes two notches: a locking notch 17 and a detent notch 18, in which the locking bolt 12 engages in the locked or opened position respectively. A first spring 20 is connected by pressure to the door 2 and the locking bolt 12 under compression and ensures that the locking bolt 12 is always pressed against the rotating bolt 15 with the force of this first spring 20. The first spring 20 is in this example inside the pressure cylinder 6 and is in compression contact with the pressure cylinder 6 and the pressure piston 7. A counterpart 21 is firmly fixed to the door frame part 1 and offers space with the door 2 shut for the outer part of the rotating bolt 15 in a recess, not shown.

The lock functions in the following manner: with the door 2 shut, the outer part of the rotating bolt 15 lies under pressure in the recess of the counterpart 21. The locking bolt 12 is pressed by the first spring 20 into the locking notch 17 of the rotating bolt 15 and fixes this, and thus the whole door 2, in this position by force. To open the door 2 the handle 3 is grasped with one hand and the hollow body 4 compressed at the same time. Due to the deformation of the hollow body 4 its internal volume is decreased, whereby an overpressure arises in this volume. This overpressure is transmitted via the primary connecting tube 5 into the pressure cylinder 6 and exerts there a pressure force on the pressure piston 7. The pressure piston 7 is, together with the locking bolt 12 firmly attached to it, pushed along its axis against the force of the first spring 20 away from the rotating bolt 15. The locking bolt 12 thereby frees the locking notch 17, whereby the rotating bolt 15 is no longer limited in its rotational movement. The force of the hand on the door knob 3, which is still maintained, now opens the door 2, whereby the counterpart 21 turns the rotating bolt 15 so far that the first roller race 14 snaps into the detent notch 18 and stops the rotating bolt 15 in this new position, which corresponds to the open door.

The door can, as with conventional door locks, be easily closed again simply by pulling or pushing it against the door frame section 1. The counterpart 21 in the door frame section 1 thereby captures the second roller race 19 of the rotating bolt 15 and turns it back into its starting position. In doing so, a light resistance has to be overcome at the first roller race 14, which at the start of the rotation is turned away from the detent notch 18. As soon as the door 2 lies completely against the door frame section 1, the first spring 20 pushes the locking bolt 12 back into the locking notch 17 of the rotating bolt 15, whereby the door 2 is again locked.

Fire safety means are shown in FIG. 1. These comprise here a spring block 27, which is embedded at its one end in the door 2 and at its other end lies on an additionally provided protrusion 26 of the locking bolt 12. The spring block 27 includes a second spring 31, precompressed under pressure and cast into a readily melting plastic material, and which is in particular stronger than the first spring 20, to which it is essentially opposed in parallel. Under great heat the plastic material of the spring block 27 melts, whereby the second spring 31 presses on the protrusion 26 of the locking bolt 12. The locking bolt 12 is thereby pushed away against the force of the first spring 20, whereby the rotating bolt 15 is released. In this manner it is assured that the door 2 does not remain locked in the event of a fire in the building, even following a partial or complete destruction, caused by heat, of the pneumatic system. These fire safety measures are insignificant for the normal functioning of the lock and can even be left out.

Figure 2:
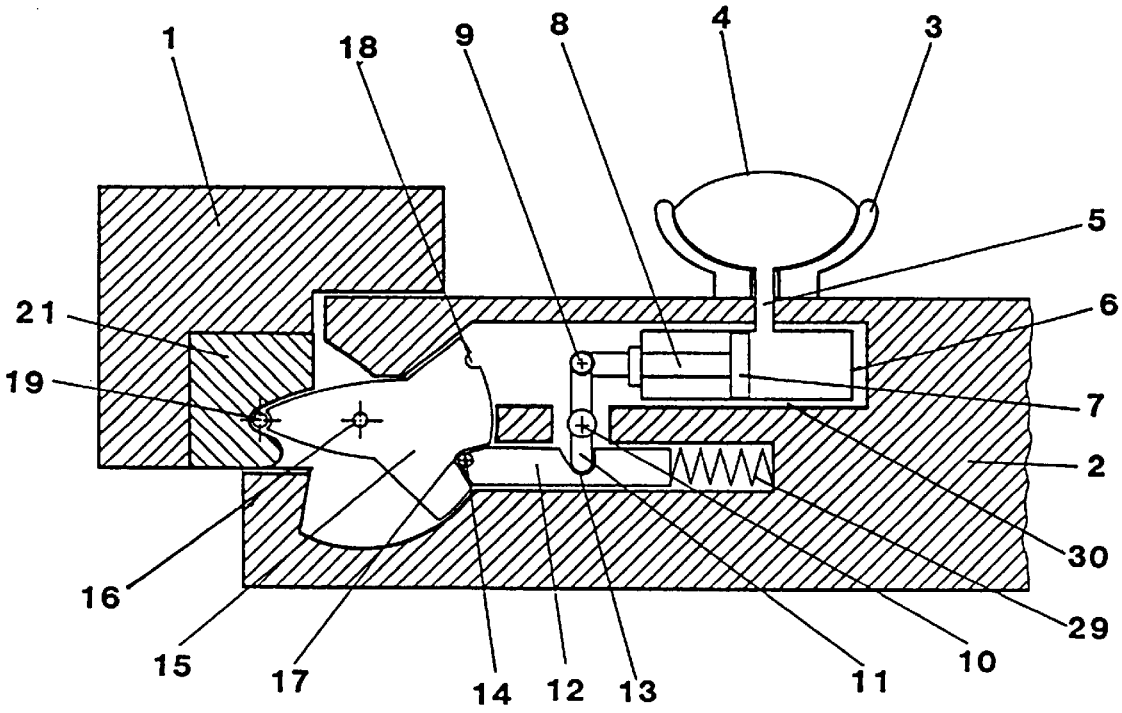
FIG. 2 is a cross section of a second embodiment of the pneumatic door lock according to the invention.

FIG. 2 shows a schematic cross section through a second form of construction of the pneumatic door lock. It differs from the form of construction described in FIG. 1 chiefly in that it includes a force conversion. This is achieved here in the following manner: the piston rod 8 has at its end a hinged joint 9 rotating about a vertical axis. The piston rod 8 is jointed non-positively to this joint 9 to one end of a conversion rod 11, which is positioned in a swivelling manner on the guide axis 10, which is firmly fixed to the door. At its other end the conversion rod 11 engages in a cut out 13 in the horizontally movable guided locking bolt 12. A compressed alternative first spring 29 replaces the first spring 20 described under FIG. 1. This is connected at one end to the locking bolt 12, and at the other end to the door 2. The remaining parts of the lock correspond to the device already described under FIG. 1, with the main difference being the movement of parts of the actuator 30, for instance, the piston rod 8, via the hinge joint 9 first turns the conversion rod 11 about the guide axis 10 through an angle in the order of magnitude of some 200 degrees. In doing so, its other end, which engages in the cut out 13 in the locking bolt 12, pushes the locking bolt 12 against the resistance of the alternative first spring 29 away from the rotating bolt 15, whereby this is released. The directions of movement in space of individual parts of the lock mechanism (6-20) are not material to the invention. They can be freely chosen according to practical considerations. Thus, for instance, the guide axis 10 can also lie horizontally.

The fire safety provision shown in FIG. 1 and in the description of this figure is not shown in FIG. 2. It can also be integrated in this embodiment.

Figure 3:
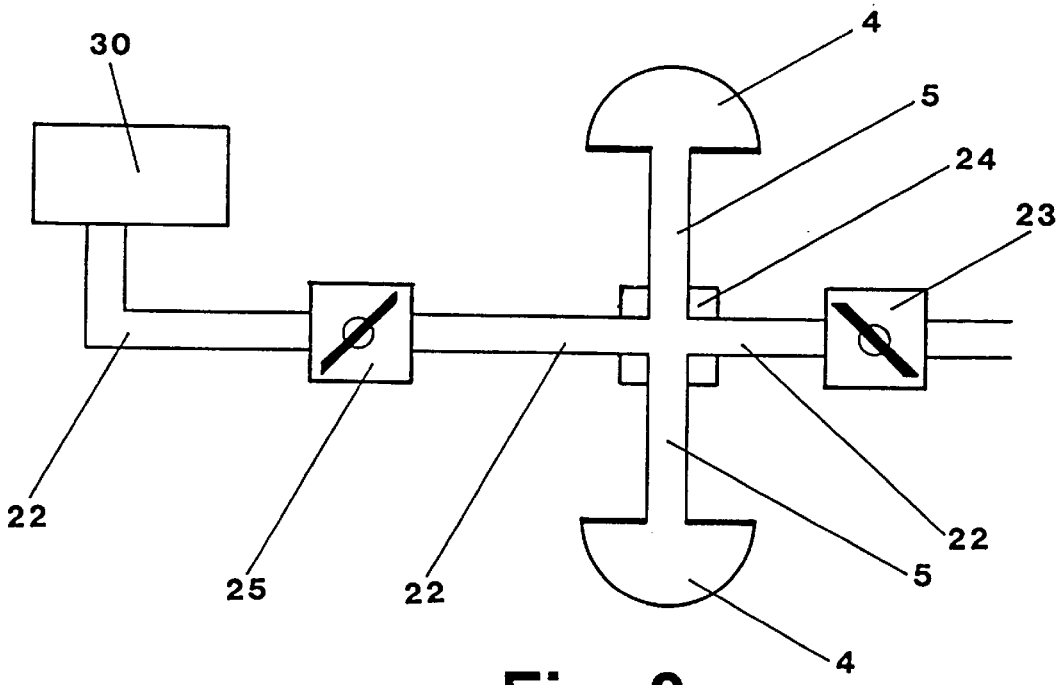
FIG. 3 is a schematic diagram of the pneumatic connections in further forms of construction of the pneumatic door lock.

FIG. 3 shows schematically an embodiment of the pneumatic means and connections according to the invention, which allows a door 2 provided with the lock to be opened from both sides and also to be locked from at least one side, with the aid of known mechanical means. On each side of the door 2 there is a door handle 3, each with a hollow body 4 and each having a primary connecting tube 5 provided. A connecting piece 24 with four connections is connected to these two primary connecting tubes 5. Its third connection is connected with secondary connecting tubes 22 first with the locking valve 25 and then with the actuator 30. The fourth connection of the connecting piece 24 is connected via a secondary connecting tube 22 to an vacuum relief valve 23.

Mechanical means, with which the locking valve 25 can be opened, are provided on at least one side of the door 2 and connected to the locking valve 25. These mechanical means, not shown, may comprise a commercially available closing cylinder, built into the door 2. If the key belonging to the closing cylinder is turned, the locking valve 25 opens and allows the air to escape so that the pressure cylinder 6 cannot be actuated. The vacuum relief valve 23 serves to ventilate the pneumatic system again after an actuation of the lock.

In a simplified embodiment, not shown, the mechanical means of locking the lock and the locking valve 25 are dispensed with; the third connection of the connecting piece 24 is connected directly to the actuator 30.

In a further embodiment, not shown, an additional quick closing valve (not shown) is built in to one of the connecting lines 22, for instance between the connecting piece 24 and the locking valve 25. The quick closing valve can advantageously only be operated from the inside of the door 2. Thus, as required, the pneumatic connection between the actuator 30 and the hollow body 4 is again interrupted whereby the door 2 can no longer be opened from the other side, even with the correct key.

What is claimed is:

1. A lock for a door and frame structure comprising a locking mechanism for attachment to said door or frame section and a counterpart for attachment to the opposing one of said door or frame section, whereby in the closed condition a pressure locked connection exists between the locking mechanism and the counterpart, the improvement comprising:

an airtight hollow body (4) is provided, manually compressible and thereby reducible in its internal volume, with which an excess pressure can be created manually, the locking mechanism (6-20) includes an actuator (30) for the conversion of an overpressure into a mechanical movement of parts (12, 15) of the locking mechanism (6-20) and this actuator (30) is connected to the hollow body (4) by at least one primary connecting tube (5), by movement of parts (12, 15) of the locking mechanism (6-20) the pressure locked connection between the locking mechanism (6-20) and the counterpart (21) is removed, the actuator (30) comprises a pressure cylinder (6), a pressure piston (7) which can move within it and a similarly movable piston rod (8) connected to it, the locking mechanism (6-20) includes a locking bolt (12) which slides linearly along its axis, the locking bolt (12) is in pressure locking contact with a movable part (8) of the actuator (30), the locking mechanism (6-20) includes a rotating bolt (15) which is assembled so that it can turn through a determined angular region, the rotating bolt (15) is in pressure locking contact with the counterpart (21) during the meeting of the locking mechanism and the counterpart, the rotating bolt (15) includes a locking notch (17) and a detent notch (18), wherein the counterpart (21) captures a part of the rotating bolt (15) extending out of the lock and turns it so that the detent notch (18) comes to rest adjacent to the locking bolt (12) during the separation of the locking mechanism and the counterpart, wherein the counterpart (21) again captures the extending part of the rotating bolt (15) and turns it so that the locking notch (17) comes to rest adjacent to the locking bolt (12) during the meeting of the locking mechanism and the counterpart, a first spring (20,29) is present, which is in pressure contact with the locking bolt (12), when the locking mechanism is engaged in the counterpart, the first spring (20,29) pushes the locking bolt (12) into the locking notch (17) and thereby fixes the rotating bolt in this position by pressure locking, when the locking mechanism is disengaged from the counterpart, the first spring (20,29) pushes the locking bolt (12) into the detent notch (18) and thus holds the rotating bolt (15) in a stable position but where the rotating bolt (15) can be forced out of the stable position, one end of the locking bolt (12) includes means (14) to reduce frictional resistance, the rotating bolt (15) includes means (19) for reducing fictional resistance at its end directed against the counterpart (21).

2. A lock for a door and frame structure comprising a locking mechanism for attachment to said door or frame section and a counterpart for attachment to the opposing one of said door or frame section, whereby in the closed condition a pressure locked connection exists between the locking mechanism and the counterpart, the improvement comprising:

an airtight hollow body (4) is provided, manually compressible and thereby reducible in its internal volume, with which an excess pressure can be created manually, the locking mechanism (6-20) includes an actuator (30) for the conversion of an overpressure into a mechanical movement of parts (12, 15) of the locking mechanism (6-20) and this actuator (30) is connected to the hollow body (4) by at least one primary connecting tube (5), by movement of parts (12, 15) of the locking mechanism (6-20) the pressure locked connection between the locking mechanism (6-20) and the counterpart (21) is removed, wherein the actuator (30) comprises a bellows, the locking mechanism (6-20) includes a locking bolt (12) which slides linearly along its axis, the locking bolt (12) is in pressure locking contact with a movable part (8) of the actuator (30), the locking mechanism (6-20) includes a rotating bolt (15) which is assembled so that it can turn through a determined angular region, the rotating bolt (15) is in pressure locking contact with the counterpart (21) during the meeting of the locking mechanism and the counterpart, the rotating bolt (15) includes a locking notch (17) and a detent notch (18), wherein the counterpart (21) captures a part of the rotating bolt (15) extending out of the lock and turns it so that the detent notch (18) comes to rest adjacent to the locking bolt (12) during the separation of the locking mechanism and the counterpart, wherein the counterpart (21) again captures the extending part of the rotating bolt (15) and turns it so that the locking notch (17) comes to rest adjacent to the locking bolt (12) during the meeting of the locking mechanism and the counterpart, a first spring (20,29) is present, which is in pressure contact with the locking bolt (12), when the locking mechanism is engaged in the counterpart, the first spring (20,29) pushes the locking bolt (12) into the locking notch (17) and thereby fixes the rotating bolt in this position by pressure locking, when the locking mechanism is disengaged from the counterpart, the first spring (20,29) pushes the locking bolt (12) into the detent notch (18) and thus holds the rotating bolt (15) in a stable position but where the rotating bolt (15) can be forced out of the stable position, one end of the locking bolt (12) includes means (14) to reduce frictional resistance, the rotating bolt (15) includes means (19) for reducing frictional resistance at its end directed against the counterpart (21).

3. A lock for a door and frame structure comprising a locking mechanism for attachment to said door or frame section and a counterpart for attachment to the opposing one of said door or frame section, whereby in the closed condition a pressure locked connection exists between the locking mechanism and the counterpart, the improvement comprising:

an airtight hollow body (4) is provided, manually compressible and thereby reducible in its internal volume, with which an excess pressure can be created manually, the locking mechanism (6-20) includes an actuator (30) for the conversion of an overpressure into a mechanical movement of parts (12, 15) of the locking mechanism (6-20) and this actuator (30) is connected to the hollow body (4) by at least one primary connecting tube (5), by movement of parts (12, 15) of the locking mechanism (6-20) the pressure locked connection between the locking mechanism (6-20) and the counterpart (21) is removed, wherein at least one valve (25) is present and is connected by airtight means via secondary tubes (22) in series between the at least one hollow body (4) and the actuator (30), wherein a mechanical means is connected to each of said at least one valves (25) for opening said valve, and wherein opening of at least one valve (25) interrupts the transmission of the overpressure in the secondary tubes (22) to the actuator (30), the locking mechanism (6-20) includes a locking bolt (12) which slides linearly along its axis, the locking bolt (12) is in pressure locking contact with a movable part (8) of the actuator (30), the locking mechanism (6-20) includes a rotating bolt (15) which is assembled so that it can turn through a determined angular region, the rotating bolt (15) is in pressure locking contact with the counterpart (21) during the meeting of the locking mechanism and the counterpart, the rotating bolt (15) includes a locking notch (17) and a detent notch (18), wherein the counterpart (21) captures a part of the rotating bolt (15) extending out of the lock and turns it so that the detent notch (18) comes to rest adjacent to the locking bolt (12) during the separation of the locking mechanism and the counterpart, wherein the counterpart (21) again captures the extending part of the rotating bolt (15) and turns it so that the locking notch (17) comes to rest adjacent to the locking bolt (12) during the meeting of the locking mechanism and the counterpart, a first spring (20,29) is present, which is in pressure contact with the locking bolt (12), when the locking mechanism is engaged in the counterpart, the first spring (20,29) pushes the locking bolt (12) into the locking notch (17) and thereby fixes the rotating bolt in this position by pressure locking, when the locking mechanism is disengaged from the counterpart, the first spring (20,29) pushes the locking bolt (12) into the detent notch (18) and thus holds the rotating bolt (15) in a stable position but where the rotating bolt (15) can be forced out of the stable position, one end of the locking bolt (12) includes means (14) to reduce frictional resistance, the rotating bolt (15) includes means (19) for reducing frictional resistance at its end directed against the counterpart (21).

4. A lock according to any one of claims 1, 2, or 3, wherein a fire safety means (27, 31) including a spring block (27) is present, the spring block (27) contains a pre-compressed second spring (31), the second spring is cast into a material, which will melt as a result of temperatures encountered during a fire, the locking bolt (12) includes a protrusion (26)

the spring block (27) is positioned so that the second spring exerts a force on the protrusion (26) after the melting of the material, this force is sufficient to move the locking bolt (12) against the resistance of the first spring (20, 29) so that it releases the rotating bolt (15).

5. A lock according to any one of claims 1, 2, or 3, wherein between the actuator (30) and the locking bolt (12) a mechanical power converter (9, 10, 11, 13) is present, which has a hinge joint (9), a guide axis (10) and a conversion rod (11), the locking bolt (12) has a cut out (13), the conversion rod (11) is joined in a hinged manner at one end via the hinge joint (9) to a movable part (8) of the actuator (30), the conversion rod (11) is assembled so that it can turn within a determined angular region about the guide axis (10), the other end of the conversion rod (11) engages in the cut out (13) of the locking bolt (12).

6. A lock according to claim 5, wherein a fire safety means (27, 31) including a spring block (27) is present, the spring block (27) contains a pre-compressed second spring (31), the second spring is cast into a material, which will melt as a result of temperatures encountered during a fire, the locking bolt (12) includes a protrusion (26)

the spring block (27) is positioned so that the second spring exerts a force on the protrusion (26) after the melting of the material, this force is sufficient to move the locking bolt (12) against the resistance of the first spring (20, 29) so that it releases the rotating bolt (15).

* * * * *

UNITED STATES PATENT AND TRADEMARK OFFICE

CERTIFICATE OF CORRECTION

PATENT NO. : 6,106,032
DATED : August 22, 2000
INVENTOR(S) : Mathias Och

It is certified that error appears in the above-identified patent and that said Letters Patent is hereby corrected as shown below:

Item [73] Assignee:
Replace "Denmark" with -- Germany --

Column 5,
Line 17, replace "fictional" with -- frictional --

Signed and Sealed this

Eleventh Day of December, 2001

*Attest:*

Nicholas P. Godici

NICHOLAS P. GODICI
*Acting Director of the United States Patent and Trademark Office*

*Attesting Officer*